United States Patent [19]

Cole

[11] Patent Number: 4,886,080

[45] Date of Patent: Dec. 12, 1989

[54] COSMETIC CONTAINER AND ASSEMBLY

[76] Inventor: Rodney D. Cole, 24 Pine Walk, Cobham, Surrey, England

[21] Appl. No.: 147,616

[22] Filed: Jan. 22, 1988

Related U.S. Application Data

[63] Continuation of Ser. No. 791,293, Oct. 25, 1985, abandoned.

[30] Foreign Application Priority Data

Oct. 25, 1984 [GB] United Kingdom ..... 8426985

[51] Int. Cl.[4] ..... A45D 40/00

[52] U.S. Cl. ..... 132/320; 401/126; 401/127; 132/317

[58] Field of Search ..... 132/88.7, 79 C, 82 R, 132/82 A, 79 R, 320, 286, 294, 300, 310, 314, 317, 318, 293; 206/38; 401/129, 126, 130, 123, 127

[56] References Cited

U.S. PATENT DOCUMENTS

| | | | |
|---|---|---|---|
| 158,066 | 12/1874 | Hall | 401/126 |
| 982,287 | 1/1911 | Metzger | 401/130 |
| 1,089,683 | 3/1914 | Stapler | 132/79 A |
| 1,626,312 | 4/1927 | Tipton | 132/79 C |
| 1,933,538 | 11/1933 | Brazelton | 132/79 C |
| 2,141,327 | 12/1938 | Younghusband | 401/123 |
| 2,273,495 | 2/1942 | Nelson | 401/122 |
| 2,347,060 | 4/1944 | Pappas | 432/79 C |
| 2,504,677 | 4/1950 | Fraser et al. | 132/79 F |
| 2,691,184 | 10/1954 | Miller et al. | 401/129 |
| 2,902,041 | 9/1959 | Bau | 132/79 R |
| 3,146,806 | 9/1964 | Ginsburg | 401/126 |
| 3,480,371 | 11/1969 | Lee | 401/122 |

FOREIGN PATENT DOCUMENTS

| | | | |
|---|---|---|---|
| 1158602 | 12/1983 | Canada | 401/129 |
| 3240152 | 5/1984 | Fed. Rep. of Germany | 401/129 |

*Primary Examiner*—Kenneth J. Dorner
*Assistant Examiner*—J. Hakomaki
*Attorney, Agent, or Firm*—Lerner, David, Littenberg, Krumholz & Mentlik

[57] ABSTRACT

A cosmetics package according to the invention includes a container for a liquid, semi-liquid, paste-like or viscous cosmetics material, e.g. mascara, and a plurality of material applicators detachably secured to the container and having elongate portions projecting into the container. There is a plurality of openings into the container, each opening being defined by a projecting neck onto which a closure cap portion of a respective applicator can be detachably secured, e.g. by screw-fitting. The elongate portion of each applicator comprises a shaft attached at one end to the closure cap and having at its other end a material-retaining/applicating portion. The interior of the container may be sub-divided into mutually separate spaces for containing different cosmetics material, each opening providing access into a respective one of said spaces.

10 Claims, 2 Drawing Sheets

COSMETIC CONTAINER AND ASSEMBLY

This is a continuation of application Ser. No. 791,293 filed Oct. 25, 1985, now abandoned.

FIELD OF THE INVENTION

The present invention concerns a container for cosmetics material and an assembly comprising such container in combination with means for the application of cosmetics product contained in the container.

BACKGROUND TO THE INVENTION

Cosmetics applicator assemblies are well known which comprise a container for cosmetics material and an applicator for the material in the container, the applicator being integral with a closure adapted to close an opening of the container. For example, in a well known form of mascara package, a tubular container has an opening onto which a closure cap can screw, or snap-fit, the cap also serving as the handle of an applicator which also includes an elongate shaft attached at one end to the cap and projecting into the container, the other end of the shaft carrying or being adapted to provide a material retaining portion which may comprise a bristle brush, a row or rows of teeth integrally moulded with the shaft, or other types of surface formation. This general construction is applicable for many different types of liquid, semi-liquid, paste-like and viscous cosmetic products. Commonly, a wiper element is carried in the neck of the container, the wiper element defining a wiping orifice which can clean the shaft of the applicator as it is withdrawn from the container and wipe the material-retaining portion of excess material so controlling the amount of material to be carried on the withdrawn applicator.

This form of package is generally quite satisfactory, but presents certain limitations for the user in that only one combination of cosmetics material/applicator type is available in the one package. Accordingly, further separate make-up packages and/or applicators will be required for the application of different cosmetic materials, or for the application of the same material using a different form of applicator. It will be appreciated that different forms of applicator are suitable for the application of cosmetics material to different parts of the face. For example, the application of mascara to the eyelashes is most efficiently performed using application surfaces projecting laterally from an elongate end portion of the applicator, while the application of the same material to the corner of the eye adjacent the bridge of the nose ideally requires a fine pointed brush of bristles projecting axially from the end of a shaft. It will also be appreciated that a variety of different cosmetic materials are required to create a full facial make-up effect.

The present invention seeks to provide a cosmetics package and a container for such a package providing improvements in these respects.

SUMMARY OF THE INVENTION

Accordingly, in one aspect the invention provides a cosmetics package comprising a container for a liquid, semi-liquid, paste like or viscous cosmetics material, and a plurality of applicators for said material, each applicator being detachably secured to the container and having a portion projecting into the container for contact with the material.

In another aspect the present invention provides a container for liquid, semi-liquid, paste-like or viscous cosmetic material, the container having a plurality of openings for providing access to the contained cosmetic material using an elongate material applicator.

These openings preferably comprise projecting neck portions onto which closure caps can be fitted, e.g. by screw-threading or snap-action. The closure caps preferably also serve as handle portions for respective material applicators, each of which also includes an elongate shaft projecting into the container through the respective opening and carrying at or adjacent its end within the container a portion for retaining the cosmetic material.

Each opening may also accommodate a respective wiper element defining a wiping aperture through which the shaft and material retaining portion of the applicator is inserted into and withdrawn from the container. This wiping aperture may be circular and of such a diameter as to wipe an outer cylindrical surface of the applicator shaft, the material retaining portion also being wiped of excess material by the wiping aperture as it is withdrawn from the container.

By using different types of applicator and/or wiper elements in the respective apertures, a versatile cosmetics applicator package can be provided. For example, the two applicators could be adapted for the application of mascara to the two different parts of the face mentioned earlier, the wipers being adapted for appropriate wiping of these different types of applicator.

In a further modification, the interior of the container can be sub-divided to provide mutually separated spaces for accommodating different cosmetic materials, each of the openings providing access to a respective one of said interior spaces. For example, one of these spaces could contain a mascara material, while the other contained an eyeliner, the respective applicators and wipers being specially adapted for application of the respective materials.

DESCRIPTION OF THE PREFERRED EMBODIMENTS

Some particular embodiments of the invention will now be described by way of example with reference to the accompanying drawings.

Figure 1:
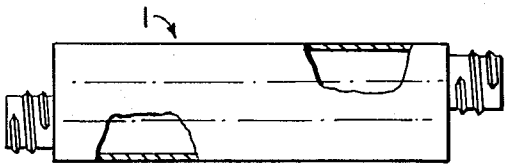
FIG. 1 shows mainly in side elevation, and partly in section, a container, in accordance with the present invention, for cosmetics material.
Figure 2:
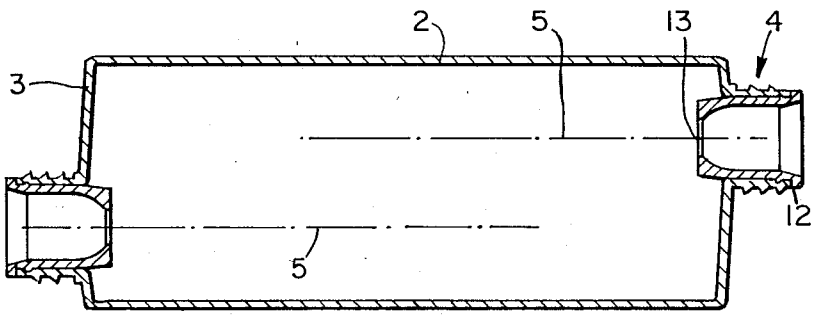
FIG. 2 is a longitudinal cross-section of the container shown in FIG. 1, shown to an enlarged scale.

With reference first to FIGS. 1 and 2, there is shown a generally cylindrical container 1 which comprises a cylindrical side wall 2 and opposite end walls 3. Each end wall is formed with one opening which comprises a generally cylindrical neck 4 projecting axially from the respective end wall. Each of these openings provides access to the interior of the container for an elongate applicator for the cosmetics material (not shown) contained within the container. In the illustrated embodiment, the axes 5 of the openings are mutually off-set so that as shown in FIG. 3 elongate applicators can lie along side one another inside the container.

Figure 3:
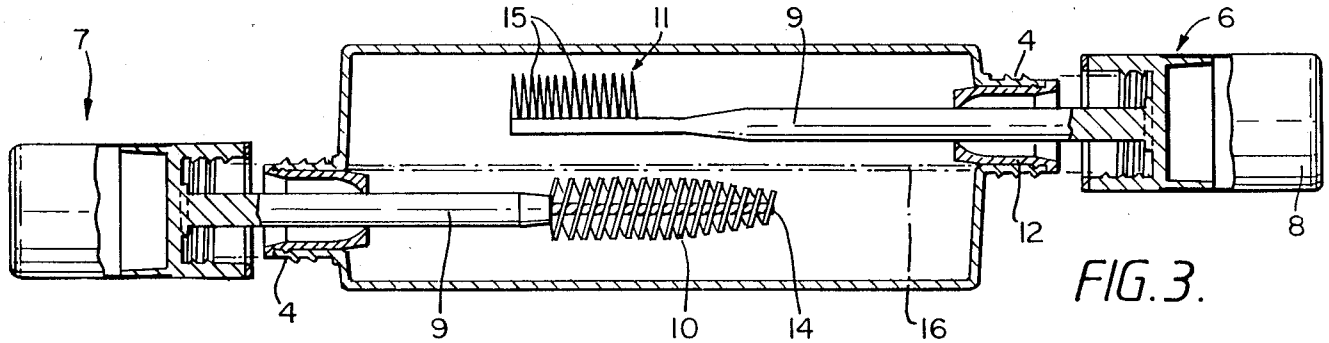
FIG. 3 is a longitudinal cross-section corresponding to FIG. 2, showing the same container in combination with two material applicators.

In the cosmetics package shown in FIG. 3, the cosmetics container of FIGS. 1 and 2 is assembled with a pair of material applicators 6 and 7. Each of these applicators comprises a closure cap portion 8 adapted to fit onto the respective neck portion 4 to seal the opening, and an elongate shaft 9 fixed at one end to the cap so as to project into the container through the opening, each shaft 9 carrying at its other end a material-retaining and application portion 10, 11. In the illustrated embodiment, the caps 8 are internally screw-threaded for engagement with an external screw-threading on the outer surface of the neck. In FIG. 3 the applicators are shown unscrewed from the respective necks 4 and partly withdrawn from the container.

Each of the necks accommodates a wiper insert 12 comprising a generally tubular element which push-fits into the neck, and which defines at its inner end a wiping orifice 13. The shape and dimension of this orifice 13 is such that as the applicator is withdrawn from the container, the shaft 9 is wiped clean of the cosmetics material adhering thereto; the orifice will also wipe excess material from the material-retaining portion 10 or 11 so that a controlled amount of the material will be retained thereon upon its withdrawal.

As shown in FIG. 3, different forms of material-retaining portion can be provdided at the ends of the two applicators. In the particular embodiment, shown only for the purposes of exemplary illustration, the applicator 7 carries a brush in which bristles are rooted in a twisted wire stem 14 and form helical flightings. The other applicator 6 is integrally formed with a row or rows of teeth 15 which project laterally from the end of the shaft 9. Accordingly, the illustrated assembly provides in a single unit alternative forms of applicator for the application of the material contained in the double-necked container.

The wiping orifices 13 of the insert 12 may be differently shaped and/or dimensioned to provide different wiping effects on the respective material-retaining portions. This feature of different wiping orifices may also be applied where identical applicators are used, the different orifices providing different wiping effects to provide different degrees of loading of the identical material retaining portions with the cosmetics material.

The space within the container may be sub-divided by a longitudinally extending internal wall 16 as shown in FIG. 3. In this modification, different materials may be provided in the separated compartments within the container, and identical, or different combinations of material-retaining portion on the applicators and shape of wiping orifice may be used.

Figure 4:
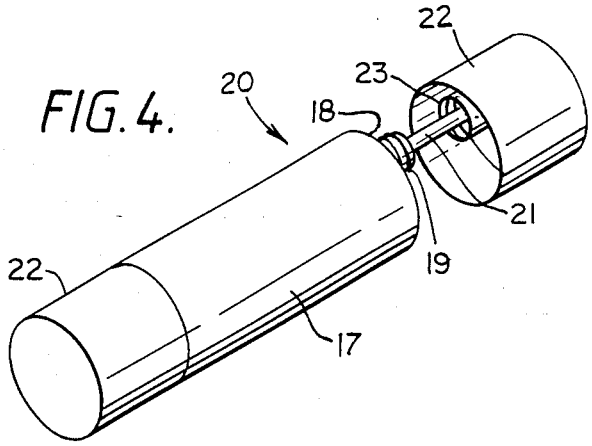
FIG. 4 is a perspective view of a cosmetics package according to a modified embodiment of the invention.

In the modified embodiment shown in FIG. 4, an elongate cylindrical container 17 is again provided in its two opposite end walls 18 (only one of which is seen in the figure) with respective mutually offset openings comprising axially projecting cylindrical, screw-threaded necks 19. Again, there are two applicators 20, each including an elongate shaft 21 projecting from a closure cap 22 adapted to fit onto the neck 19, the outer end of the shaft carrying an application portion (not shown). In this embodiment, however the sectional profile of each cap is the same as that of the container, the arrangement being such that when the caps are tightly fitted on the necks these profiles match so as to form an elongate package of uniform outer profile. To ensure this, each cap is formed with an eccentrically disposed internally screw threaded cylindrical closure member 23 which screw-threadedly engages the neck 19, the threads being one-start threads and arranged to tighten at the correct relative rotational position of the container and cap. The cross-sectional profile of the container and cap can be non-circular if desired.

Figure 5:
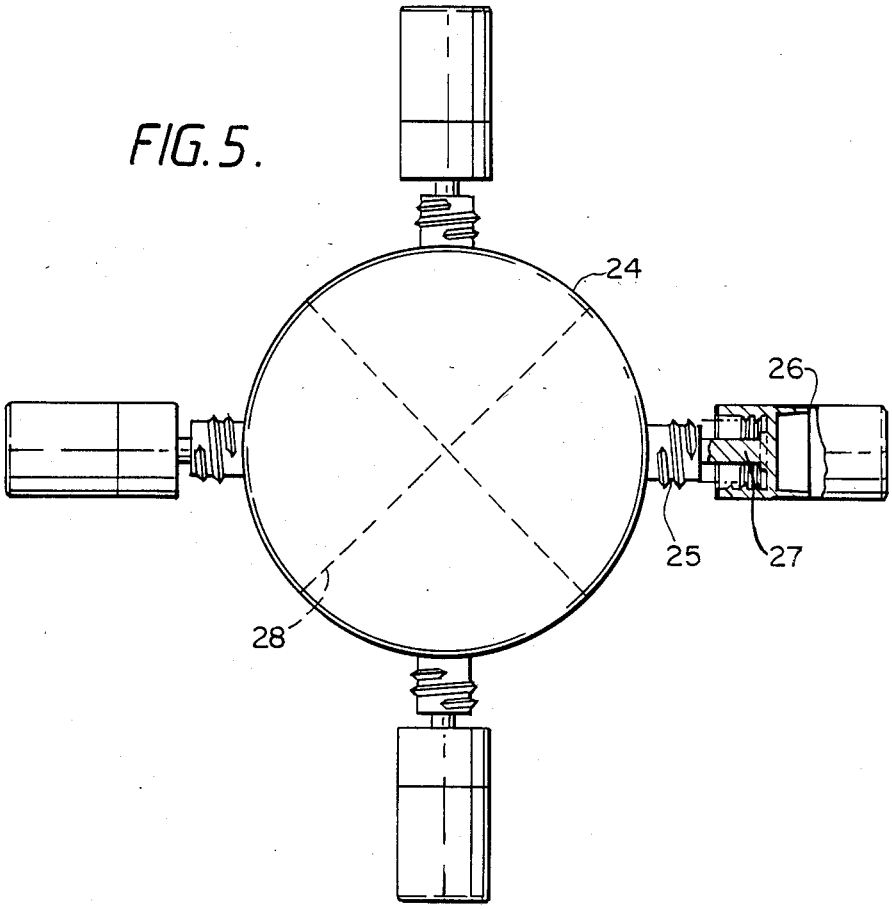
FIG. 5 shows a container in accordance with another embodiment of the invention for cosmetics material.

In the embodiment illustrated in FIG. 5, the container is generally circular, a plurality of circumferentially spaced openings being provided in the cylindrical side wall 24 of the container. Again, each of these openings comprises an externally screw-threaded neck 25 opening into the interior of the container. Associated with each neck is a respective material applicator, again comprising an internally screw-threaded cap 26 integral with an elongate shaft 27 which can project through the neck into the interior of the container, the end (not shown) of the applicator being provided with a material-retaining portion for retaining and applying the cosmetics material in the container. As in the previous embodiment, each of the neck portions 25 can accommodate an appropriately shaped wiper insert for wiping the exterior surface of the shaft 27 and the material-retaining portion on withdrawal from the container.

The embodiment of FIG. 5 provides the same possibilities as in the previous embodiment. For example, there may be a single space within the container, each of the applicators being provided with a different form of material-retaining portion to be used for applying the material in different areas of the face. Different forms of wiper insert may be provided in the respective neck portions 25 to provide different wiping effects upon applicators of the same or different construction. The interior of the container may also be sub-divided into a plurality of sector-shaped interior compartments by internal walls 28, each neck 25 opening into a respective one of these compartments. In this modification, different cosmetic products can be provided in the different compartments, and the same, or different combinations of wiper/applicator can be provided for the different compartments.

It will be appreciated from the above that the constructions described in accordance with the invention provide in a single cosmetics package selection of at least one feature of usage, e.g. type of applicator, wiping effect on the applicator, material to be applied.

I claim:

1. A package comprising a container holding a liquid, semi-liquid, paste-like or viscous material directly in contact with the interior of the container, the container having first and second opposed ends formed with respective first and second openings; a first applicator for the first opening; and a second applicator for the second opening, each applicator including a closure cap, securing means for detachably securing the closure cap to a respective opposed end of the container for sealingly closing the opening thereat, and an applicator portion projecting from each closure cap into contact with the material in the container, each applicator portion withdrawing a portion of the material from within the container upon removal of each applicator from the container through its respective opening, each applicator extending into the container a distance more than half of the distance between the opposed ends whereby the applicator portions are disposed along side each other in the container.

2. A package according to claim 1 wherein each said opening is formed by a projecting neck, the securing means being arranged for detachably securing each closure cap to the respective neck so as to close the opening, said portion of said applicator comprising a shaft fixed at one end to said closure cap so as to project through said neck into said container.

3. A package according to claim 2 wherein each applicator further includes a material-retaining portion formed or carried at the other end of said shaft and adapted to retain cosmetics materials.

4. A package according to claim 2 wherein said closure cap and said neck formed with mutually engageable screw-threads.

5. A package according to claim 2 wherein said closure cap and said neck are adapted for snap-action mutual engagement.

6. A package according to claim 1 wherein each closure cap has a sectional profile matching that of the container.

7. A package according to claim 3 wherein each said opening of the container includes wiping means defining a wiping aperture through which the shaft and material-retaining portion will be inserted into and withdrawn from the container.

8. A cosmetics package according to claim 1 wherein the interior of the container is sub-divided into mutually separated spaces, each of said applicators, when secured to the container, having its said portion projecting into a respective on of said spaces.

9. A package according to claim 1 wherein said portions of said applicators comprise different forms of material-retaining and applying element for retaining and applying a liquid, semi-liquid, viscous or paste-like cosmetics material.

10. A package according to claim 1 wherein said openings have respective axes, the axes being mutually offset.

* * * * *

UNITED STATES PATENT AND TRADEMARK OFFICE

CERTIFICATE OF CORRECTION

PATENT NO. : 4,886,080

DATED : December 12, 1989

INVENTOR(S) : Rodney D. Cole

It is certified that error appears in the above-identified patent and that said Letters Patent is hereby corrected as shown below:

Column 5, line 17, between "neck formed", insert --are--.
Column 6, line 9, delete "cosmetics".

Signed and Sealed this

Ninth Day of April, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,886,080

DATED : December 12, 1989

INVENTOR(S) : Rodney D. Cole

It is certified that error appears in the above-identified patent and that said Letters Patent is hereby corrected as shown below:

Column 5, line 17, between "neck formed", insert --are--.
Column 6, line 9, delete "cosmetics".

Signed and Sealed this

Fourth Day of August, 1992

*Attest:*

DOUGLAS B. COMER

*Attesting Officer*

*Acting Commissioner of Patents and Trademarks*